US012140384B2

(12) United States Patent
Dahlberg et al.

(10) Patent No.: US 12,140,384 B2
(45) Date of Patent: Nov. 12, 2024

(54) HEAT EXCHANGER WITH INDENTATIONS FOR AVOIDING STAGNANT MEDIA

(71) Applicant: SWEP International AB, Landskrona (SE)

(72) Inventors: Tomas Dahlberg, Helsingborg (SE); Sven Andersson, Hässleholm (SE)

(73) Assignee: SWEP International AB, Landskrona (SE)

( * ) Notice: Subject to any disclaimer, the term of this patent is extended or adjusted under 35 U.S.C. 154(b) by 228 days.

(21) Appl. No.: 17/784,259

(22) PCT Filed: Dec. 9, 2020

(86) PCT No.: PCT/SE2020/051181

§ 371 (c)(1),
(2) Date: Jun. 10, 2022

(87) PCT Pub. No.: WO2021/133237

PCT Pub. Date: Jul. 10, 2021

(65) Prior Publication Data

US 2023/0043151 A1 Feb. 9, 2023

(30) Foreign Application Priority Data

Dec. 23, 2019 (SE) ..... 1951549-3

(51) Int. Cl.
*F28D 9/00* (2006.01)
*F28F 3/04* (2006.01)

(52) U.S. Cl.
CPC ..... *F28D 9/005* (2013.01); *F28F 3/042* (2013.01)

(58) Field of Classification Search
CPC ..... F28D 9/005; F28D 9/0037; F28F 13/06; F28F 3/042; F28F 3/086; F28F 9/02;
(Continued)

(56) References Cited

U.S. PATENT DOCUMENTS 5,988,269 A * 11/1999 Karlsson ..... F28D 9/005 165/DIG. 372
8,869,398 B2 * 10/2014 Kent ..... B21D 53/04 29/890.03

(Continued)

FOREIGN PATENT DOCUMENTS

CN 110234949 A 9/2019
EP 0857288 B1 8/2001

(Continued)

OTHER PUBLICATIONS

PCT International Search Report for PCT Application No. PCT/SE2020/051181 mailed Feb. 2, 2021 (4 pages).

(Continued)

*Primary Examiner* — Henry T Crenshaw
*Assistant Examiner* — Kamran Tavakoldavani
(74) *Attorney, Agent, or Firm* — Merchant & Gould P.C.

(57) ABSTRACT

A brazed plate heat exchanger (10) comprises an end plate (11) and a stack of heat exchanger plates (12, 12a, 12b) provided with a pattern comprising ridges (R) and grooves (G) adapted to form contact points (16) between neighboring heat exchanger plates such that the heat exchanger plates form interplate flow channels for media to 5 exchange heat over the heat exchanger plates, the heat exchanger plates further being provided with port openings (O1-O4) for selective fluid communication with the flow channels, wherein the port openings are surrounded by port opening areas (13) for sealing against a corresponding port opening area of a neighbouring heat exchanger plate, wherein neighboring heat exchanger plates are connected by brazing joints at said contact points (16), wherein the end plate (11) is provided with port openings (O1-O4) and flat areas (14) around the port openings in a common plane, wherein a plurality of ridges (R) of the heat exchanger plates, in an area (Continued)

overlapping any of said flat areas (14) of the end plate (11), are formed with an indentation (15).

12 Claims, 10 Drawing Sheets

(58) Field of Classification Search
CPC ..... F28F 2225/04; F28F 2250/04; F28F 2275/04; F28F 2265/16; F25B 13/00; F25B 39/00; F25B 39/04; F24H 4/02
See application file for complete search history.

(56) References Cited

U.S. PATENT DOCUMENTS

| | | | | |
|---|---|---|---|---|
| 11,841,195 | B2 | 12/2023 | Dahlberg et al. | |
| 2016/0250703 | A1* | 9/2016 | Bornegard ..... | B23K 1/008 165/167 |

FOREIGN PATENT DOCUMENTS

| | | | |
|---|---|---|---|
| JP | 2011137623 | A | 7/2011 |
| WO | 97/15798 | A1 | 5/1997 |
| WO | 2007/021491 | A1 | 3/2007 |
| WO | 2009/123518 | A1 | 10/2009 |
| WO | 2011/073083 | A1 | 6/2011 |
| WO | 2015/040065 | A1 | 3/2015 |
| WO | 2015/062992 | A1 | 5/2015 |
| WO | 2015/062992 | A9 | 5/2015 |

OTHER PUBLICATIONS

PCT Written Opinion for PCT Application No. PCT/SE2020/051181 mailed Feb. 2, 2021 (6 pages).
Swedish Search Report for SE Application No. 1951549-3 mailed May 28, 2020 (2 pages).
Swedish Office Action for SE Application No. 1951549-3 mailed May 28, 2020 (5 pages).
English Translation of Office Action dated Jul. 6, 2024 for corresponding Chinese Application No. 202080089475.6 (9 pages).

* cited by examiner

HEAT EXCHANGER WITH INDENTATIONS FOR AVOIDING STAGNANT MEDIA

This application is a National Stage Application of PCT/SE2020/051181, filed 9 Dec. 2020, which claims benefit of Serial No. 1951549-3, filed 23 Dec. 2019 in Sweden, and which applications are hereby incorporated by reference in their entireties. To the extent appropriate, a claim of priority is made to each of the above disclosed applications.

FIELD OF THE INVENTION

The present invention relates to a heat exchanger with indentations for avoiding stagnant media. More specifically, the present invention relates to a brazed plate heat exchanger comprising an end plate and a stack of heat exchanger plates provided with a pattern comprising ridges and grooves adapted to form contact points between neighbouring heat exchanger plates such that the heat exchanger plates form interplate flow channels for media to exchange heat over the heat exchanger plates. The heat exchanger plates are further being provided with port openings for selective fluid communication with the flow channels, wherein the port openings are surrounded by port opening areas for sealing against a corresponding port opening area of an adjacent heat exchanger plate. Neighbouring heat exchanger plates are connected by brazing joints at said contact points. The end plate is provided with port openings and flat areas around the port openings in a common plane. A plurality of ridges of the heat exchanger plates, in an area overlapping a flat area of the end plate, are formed with an indentation, wherein said indentations of a heat exchanger plate adjacent the end plate connect a flow channel, formed between the end plate and the adjacent heat exchanger plate, with a neighbouring flow channel to allow distribution of media between them.

PRIOR ART

When exchanging heat between different media in any type of heat exchanger, it is generally favourable to avoid stagnant media, i.e. media that does not follow the general flow path but rather stands still. Stagnant media is cumbersome for many reasons: bacterial or microbial growth may occur in the stagnant zones and media may freeze, hence breaking the heat exchanger. Moreover, the general efficiency of the heat exchanger may be impeded. For brazed plate heat exchangers comprising a pressed pattern of ridges and grooves keeping heat exchanger plates on a distance from one another, a historically critical area for the formation of stagnant media is between an end plate having a flat area in the vicinity of the port openings and a neighbouring heat exchanger plate, wherein the end plate forms dead-end flow channels between the end plate and the neighbouring heat exchanger plate where the media easily becomes stagnant.

EP0857288 solves the problem with stagnant media in the space between flat areas of an end plate and the neighbouring heat exchanger plate by providing distribution channels between flow channels, which otherwise would be dead-end flow channels, and neighbouring flow channels. The distribution channels allow for a flow that otherwise would be "stuck" in dead-end flow channels. The distribution channels of EP0857288 are arranged immediately adjacent a port opening area, i.e. at the very end of the ridges. Although the solution disclosed in this patent is efficient for avoiding stagnant media, it has some drawbacks when it comes to strength.

Hence, one problem with prior art heat exchangers is that they are weak and cannot withstand high pressure.

SUMMARY OF THE INVENTION

It is the object of the present invention to provide a brazed plate heat exchanger with reduced risk of stagnant media while increasing the number of contact points between the ridges and grooves of neighbouring plates around port opening areas and hence increase the strength of the heat exchanger.

The present invention is related to a brazed plate heat exchanger comprising an end plate and a stack of heat exchanger plates provided with a pattern comprising ridges and grooves adapted to form contact points between neighbouring heat exchanger plates such that the heat exchanger plates form interplate flow channels for media to exchange heat over the heat exchanger plates, the heat exchanger plates further being provided with port openings for selective fluid communication with the flow channels, wherein the port openings are surrounded by port opening areas for sealing against a corresponding port opening area of a neighbouring heat exchanger plate, wherein neighbouring heat exchanger plates are connected by brazing joints at said contact points, wherein the end plate is provided with port openings and flat areas around the port openings in a common plane, wherein a plurality of ridges of the heat exchanger plates, in an area overlapping any of said flat areas of the end plate, are formed with an indentation, wherein said indentations of a heat exchanger plate adjacent the end plate connect a flow channel, formed between the end plate and the adjacent heat exchanger plate, with a neighbouring flow channel to allow distribution of media between them, characterised in that a brazing joint for connecting neighbouring heat exchanger plates is arranged between the port opening area and at least one of said indentations.

By the provision of the indentations, trans-ridge flow channels are formed for distributing media and prevent stagnant media in flow channels that otherwise would be dead-end flow channels in the space between the end plate and the adjacent heat exchanger plate, such as the first or last heat exchanger plate in the stack. In addition it has surprisingly been found that by arranging said indentations with a small distance from the very end of the flow channel, i.e. on the ridge at a distance from the nearest port opening area, space is provided for a contact point and thus a brazing joint, while stagnant media in the flow channel still is prevented. Hence, it has been found that a favourable flow of media is achieved also when a brazing joint is arranged between the indentation and the port opening area. The brazing joints between the port opening area and at least some of the indentations result in a stronger heat exchanger. Also, contact points closer to the port opening areas is achieved, which results in smaller pressure areas around the ports. Additional contact points are achieved. Also, contact points closer to the port openings are achieved. For example, a distance between the port opening and a first row of contact points can be shorter than in the prior art and an area around the port opening exposed to media pressure is smaller. Also, a higher contact point density in the immediate vicinity of the port opening can be achieved. Together this results in a strong heat exchanger while stagnant media in the dead-end flow channels is prevented.

The end plate can be a conventional end plate with flat areas around the port openings, such as in the end sections of a rectangular end plate. The port openings and the flat areas of the end plate are arranged in a common plane. The end plate can be a front end plate or a back end plate. The flat areas of the end plate can be adapted to be connected to a hydroblock or similar conventional fittings. The end plate can be provided with a pattern of ridges and grooves in a central portion thereof.

A contact point can be arranged on the ridge on both sides of the indentations or a plurality of the indentations connecting a flow channel, which otherwise would form a dead-end flow channel together with the end plate, with a neighbouring flow channel. Hence, a very strong heat exchanger can be achieved while preventing stagnant media. Hence, the heat exchanger plates can be connected to each other by a plurality of rows of brazing joints, wherein the indentations or a plurality of indentations can be arranged between the first and second rows of brazing joints counted from the port opening area closest to the indentation.

BRIEF DESCRIPTION OF THE DRAWINGS

In the following, the invention will be described with reference to appended drawings, wherein:

FIGS. 9 and 10 are schematic front views of heat exchanger plates according to another embodiment of the present invention, wherein FIG. 9 illustrates one type of plate and FIG. 10 another type of plate to be arranged together in an alternating manner.

DESCRIPTION OF EMBODIMENTS

Figure 1:
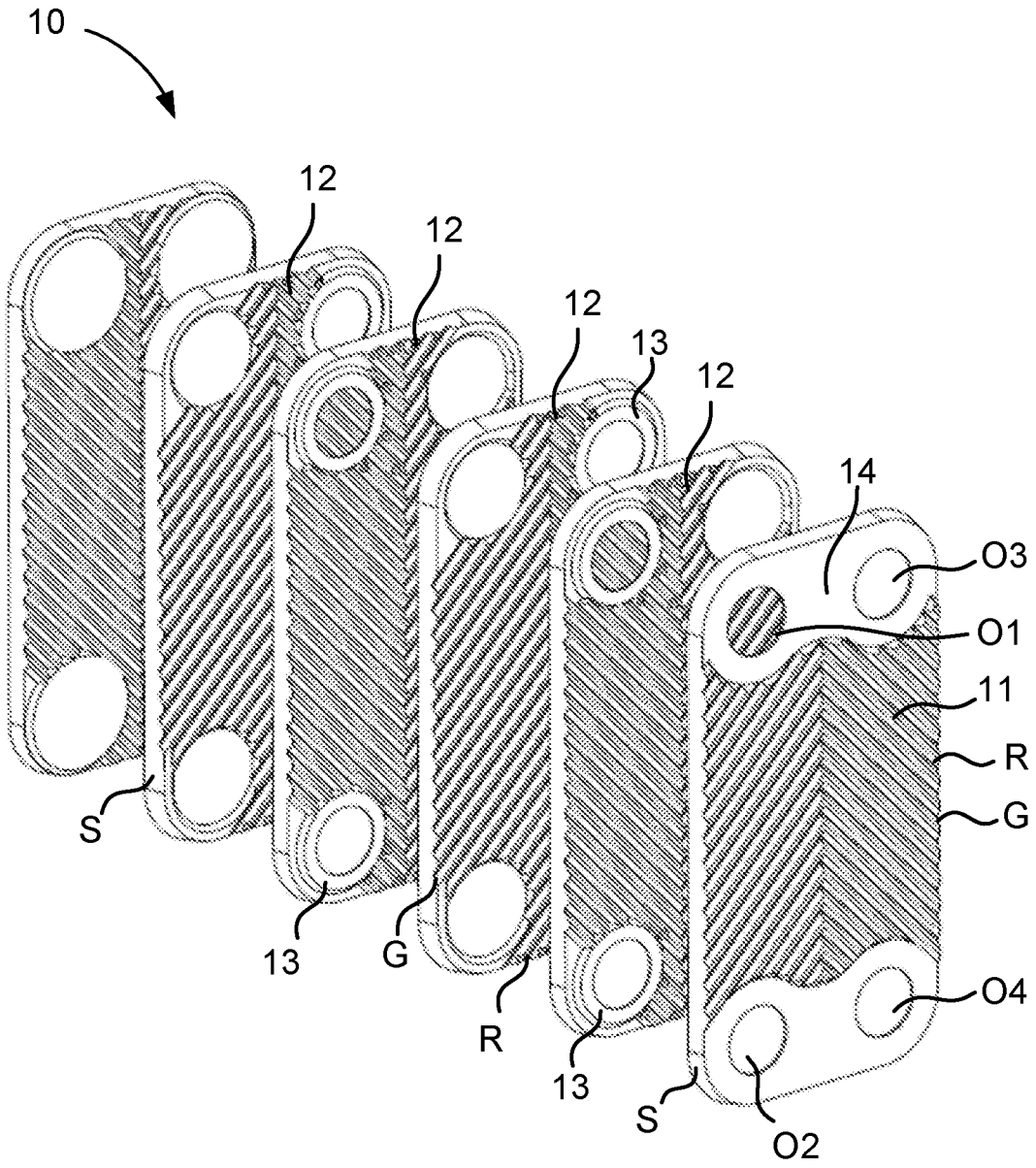
FIG. 1 is a schematic exploded view of a heat exchanger according to a first embodiment of the present invention.

With reference to FIG. 1, a heat exchanger 10 according to one embodiment of the present invention is illustrated schematically. The heat exchanger 10 comprises an end plate 11 and a plurality of heat exchanger plates 12 stacked in a stack to form the heat exchanger 10. In the embodiment of FIG. 1, the heat exchanger plates 12 are identical.

Figure 2:
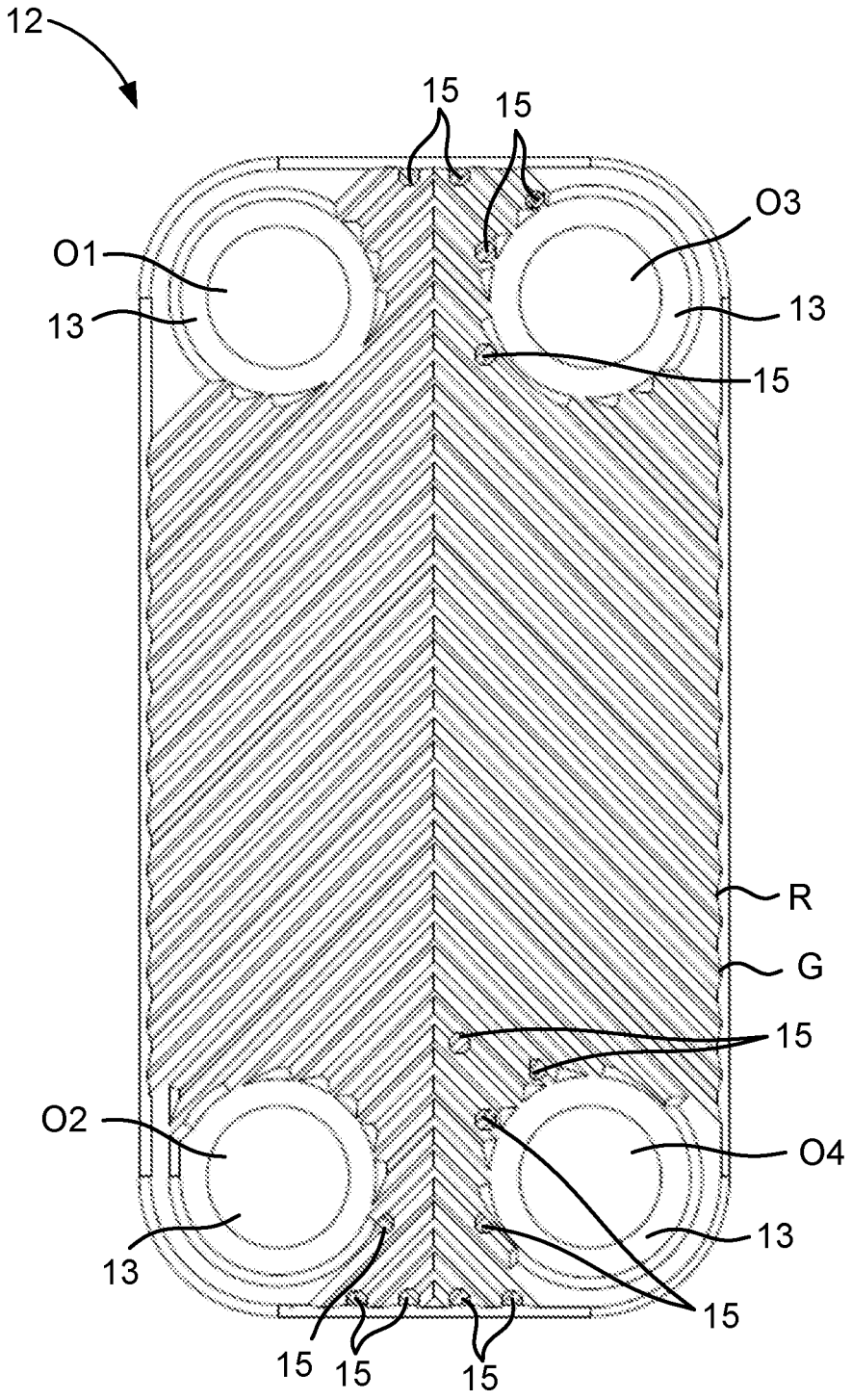
FIG. 2 is a schematic front view of a heat exchanger plate according to FIG. 1.
Figure 3:
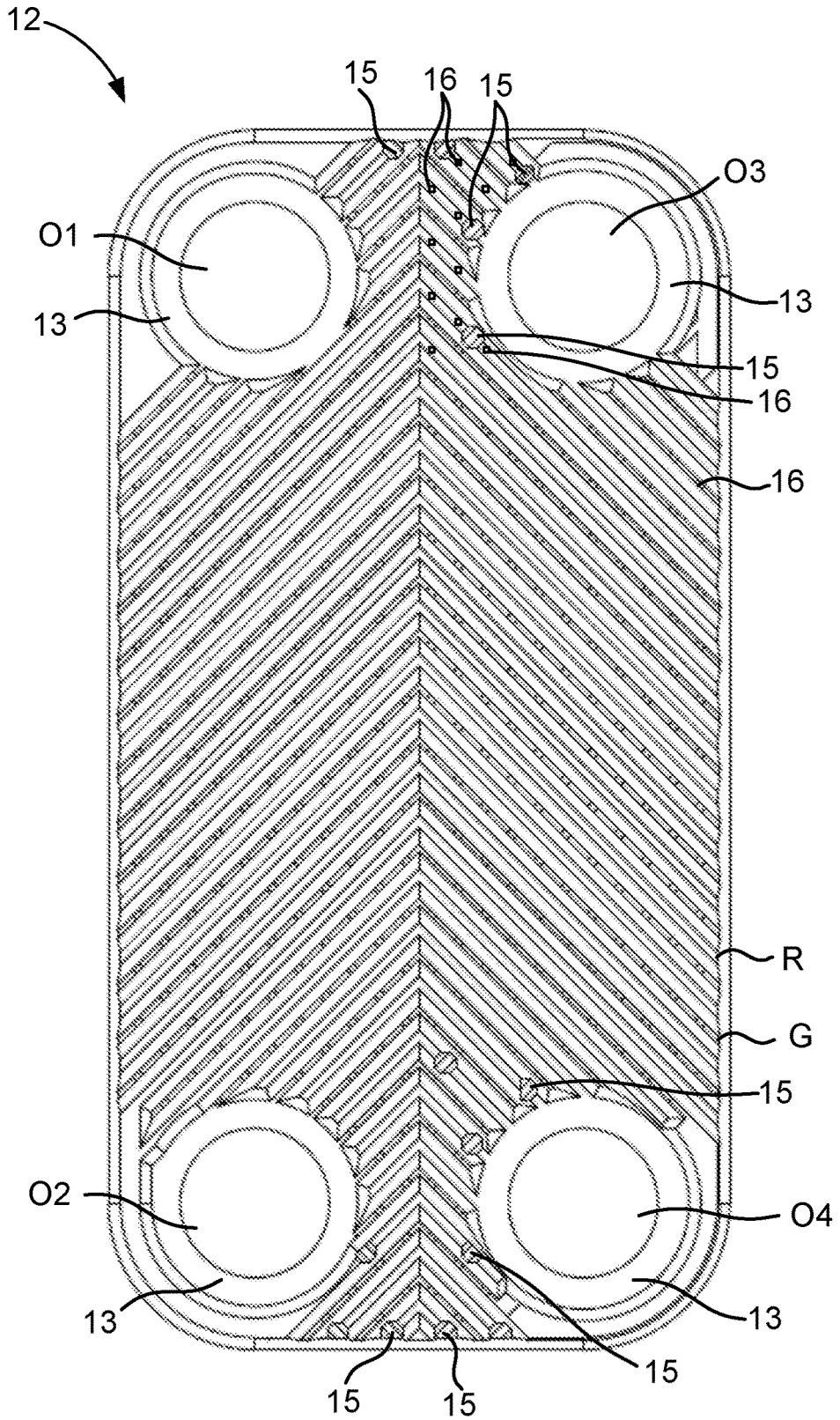
FIG. 3 is a schematic front view of the heat exchanger plate of FIG. 2 illustrating imaginary contact points between the illustrated plate and a further heat exchanger plate.

The heat exchanger plates 12 are made from sheet metal and are provided with a pattern of ridges R and grooves G such that interplate flow channels for fluids to exchange heat are formed between the plates when the plates are stacked in a stack to form the heat exchanger 10 by providing contact points between at least some crossing ridges and grooves of neighbouring plates 12 under formation of the interplate flow channels for fluids to exchange heat. The pattern according to the embodiment of FIGS. 1-3 is a herringbone pattern. However, the pattern may also be in the form of obliquely extending straight lines as described below. The pattern of ridges R and grooves G is a corrugated pattern having a corrugation depth. The pattern is a pressed pattern. The pattern is adapted to keep the plates 12 on a distance from one another, except from the contact points, to form spaces between adjacent heat exchanger plates and the flow channels.

In the illustrated embodiment, each of the heat exchanger plates 12 is surrounded by a skirt S, which extends generally perpendicular to a plane of the heat exchanger plate 12 and is adapted to contact skirts of neighbouring plates 12 in order to provide a seal along the circumference of the heat exchanger 10.

The heat exchanger plates 12 are arranged with port openings O1-O4 for letting fluids to exchange heat into and out of the interplate flow channels. In the illustrated embodiment, the end plate 11 and the heat exchanger plates 12 are arranged with four port openings O1-O4. In FIG. 1 some port openings are missing, which is understood by a skilled person and does not affect the disclosure of the present invention. Port opening areas 13 surrounding the port openings O1 to O4 are provided at different heights, i.e. different levels, such that selective communication between the port openings and the interplate flow channels is achieved. For example, the port opening areas 13 are flat. The port opening areas 13 are arranged for sealing against a corresponding port opening area 13 of an adjacent heat exchanger plate 12. For example, the port openings O1-O4 and the port opening areas 13 are arranged in a conventional manner.

In the heat exchanger 10 of FIG. 1, the port opening areas 13 are arranged such that first and second port openings O1 and O2 are in fluid communication with one another through interplate flow channels, whereas the third and fourth large port openings O3 and O4 are in fluid communication with one another by neighboring interplate flow channels. In the illustrated embodiment, the heat exchanger plates 12 are rectangular with rounded corners, wherein the port openings O1-O4 are arranged near the corners. Alternatively, the heat exchanger plates 12 are square, e.g. with rounded corners. Alternatively, the heat exchanger plates 12 are circular, oval or arranged with other suitable shape, wherein the large port openings O1-O4 are distributed in a suitable manner. In the illustrated embodiment, each of the heat exchanger plates 12 is formed with four port openings O1-O4. Alternatively, the heat exchanger plates 12 are formed with another number of ports, such as six, eight or ten. In the embodiment of FIG. 1, the heat exchanger plates 12 are identical and every other plate 12 is turned 180 degrees in its plane in relation to adjacent heat exchanger plates 12.

The end plate 11 according to FIG. 1 is formed with flat areas 14 with the port openings O1-O4. The port openings O1-O4 of the end plate 11 are aligned with the port openings of the heat exchanger plates 12 in a conventional manner. For example, the end plate 11 comprises a first end section with a first flat area and neighbouring port openings O1 and O3 and a second end section with a second flat area and neighbouring port openings O2 and O4. For example, the end plate 11 is a conventional end plate. In the illustrated embodiment, the end plate 11 comprises a central portion having a pattern of ridges (R) and grooves (G) similar to the heat exchanger plates 12. The end sections do not have the pattern of ridges and grooves. Instead the end sections are formed with the flat areas 14, at least around the port openings O1-O4. The port openings O1-O4 and the flat areas 14 are arranged in a common plane. Hence, the flat areas 14 of the end plate 11 form flow channels together with the grooves (G) of the adjacent heat exchanger plate 12, such as a first heat exchanger plate in the stack of heat exchanger plates. The flat areas 14 form flow channels together with the neighbouring heat exchanger plate 12 in the vicinity of port opening areas 13 of the neighbouring heat exchanger plate 12.

When the heat exchanger plate 12 and the end plate 11 are mounted in order to form a part of a plate heat exchanger 10, two of the port opening areas 13 will come in contact with the flat areas 14 of the end plate 11. Also, ridges R of the heat exchanger plate 12 will also come in contact with the flat areas 14 of the end plate 11. Hence, flow channels are formed between the flat area 14 in the end section of the end plate 11 and the adjacent heat exchanger plate 12. Flow channels are formed in an area between neighbouring port openings of the heat exchanger plate 12. For example, flow channels are formed between the flat areas 14 and the neighbouring heat exchanger plate 12 by the grooves G connected to the first port opening O1, wherein some grooves (G) ends when said grooves G reach the port openings area 13 around the neighbouring third port opening O3.

With reference also to FIG. 2, the heat exchanger plate 12 is provided with indentations 15. The indentations 15 are arranged to provide for trans-ridge flow channels. The indentations 15 are arranged in ridges R of the heat exchanger plate 12, wherein at least some ridges are formed with at least one indentation 15. At least some of the indentations 15 are arranged in the vicinity of the port openings O3, O4 to connect a groove G, which together with the flat area 14 forms a flow channel, with a neighbouring groove G to prevent stagnant media in said flow channel between the heat exchanger plate 12 and the flat area 14 of the end plate 11. By the provision of the indentations 15 dead-end flow channels delimited by ridges R and the flat end sections 14 of the end plate 11 are avoided. The indentations 15 are arranged with a depth corresponding to at least 5% of the corrugation depth of the heat exchanger plates 12. For example, the depth of the indentations 15 are less than 80% of the corrugation depth. For example, the depth of the indentations 15 is 20-80%, 40-80%, 50-80%, 50-60% or 50% of the corrugation depth.

With reference to FIG. 3 contact points 16 between the heat exchanger plate 12 and a further heat exchanger plate are illustrated schematically. Generally, a brazing joint is arranged in the contact points 16, wherein the contact points 16 correspond to brazing joints. For example, each contact point 16 between adjacent heat exchanger plates 12 corresponds to a brazing joint. In FIG. 3 the contact points 16 are illustrated on the back side of the heat exchanger plate 12 and the contact points 16 with a neighbouring heat exchanger plate on the front side is understood by a skilled person to be in the corresponding positions on the ridges R as illustrated schematically for a few positions by means of squares in the vicinity of the third port opening O3 in FIG. 3. As can be seen in FIG. 3 at least some of the indentations 15 are arranged with a distance to the port opening area 13 of the third port opening O3 and the fourth port opening O4 leaving space for a brazing joint between the indentation 15 and the port opening O3, O4. Hence, a brazing joint for connecting a heat exchanger plate with a neighbouring heat exchanger plate is arranged between the port opening area 13 and at least one of the indentations 15. A plurality of ridges R of the heat exchanger plates 12 is formed with an indentation 15 in an area overlapping a flat area 14 of the end plate 11. The indentations 15 of a heat exchanger plate 12 adjacent the end plate 11 connect a flow channel, formed between the flat area 14 of the end plate 11 and the adjacent heat exchanger plate 12, with a neighbouring flow channel to allow distribution of media between them and prevent stagnant media therein. At the same time, in the area overlapping the flat area 14 of the end plate 11, brazing joints for connecting neighbouring heat exchanger plates 12 are arranged between the port opening area 13 and at least one of the indentations 15 or a plurality of the indentations 15 or all of them.

In the embodiment of FIGS. 1-3 the indentations 15 of the heat exchanger plate 12 are not all placed in the immediate vicinity of the port openings O3, O4. For example, every other indentation 15 is placed on a significant distance from the port openings O3, O4. For example, at least one indentation 15 or a plurality of indentations 15 is/are arranged at a distance from the nearest port opening area 13 corresponding to a brazing joint, wherein the indentation 15 is arranged immediately adjacent the brazing joint between the indentation 15 and the port opening area 13. For example, more indentations 15 are arranged in the vicinity of the port opening area 13 surrounding the fourth port O4 than in the vicinity of the port opening area 13 surrounding the third port opening O3.

Figure 4:
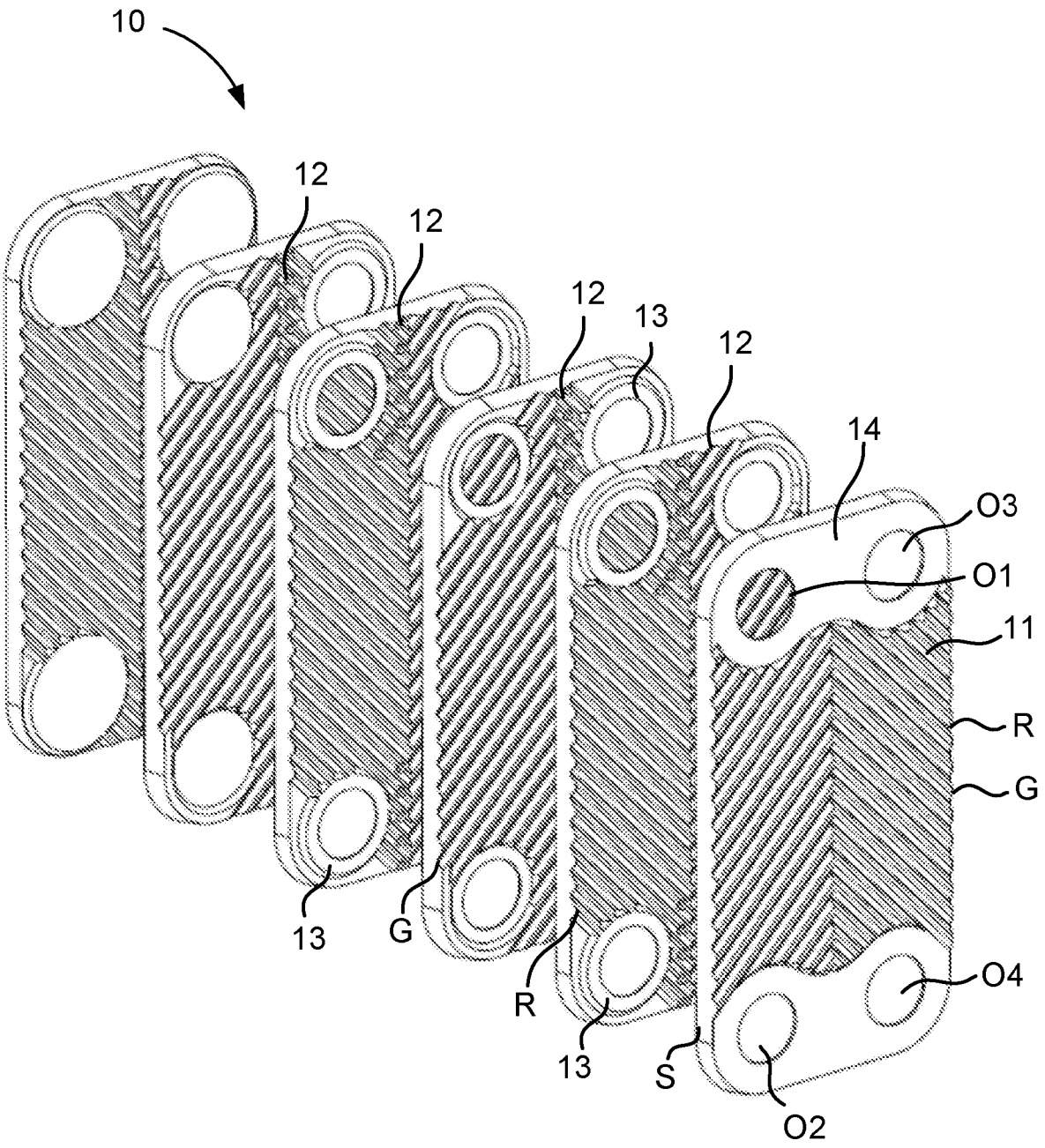
FIG. 4 is a schematic exploded view of a heat exchanger according to a second embodiment of the present invention.
Figure 5:
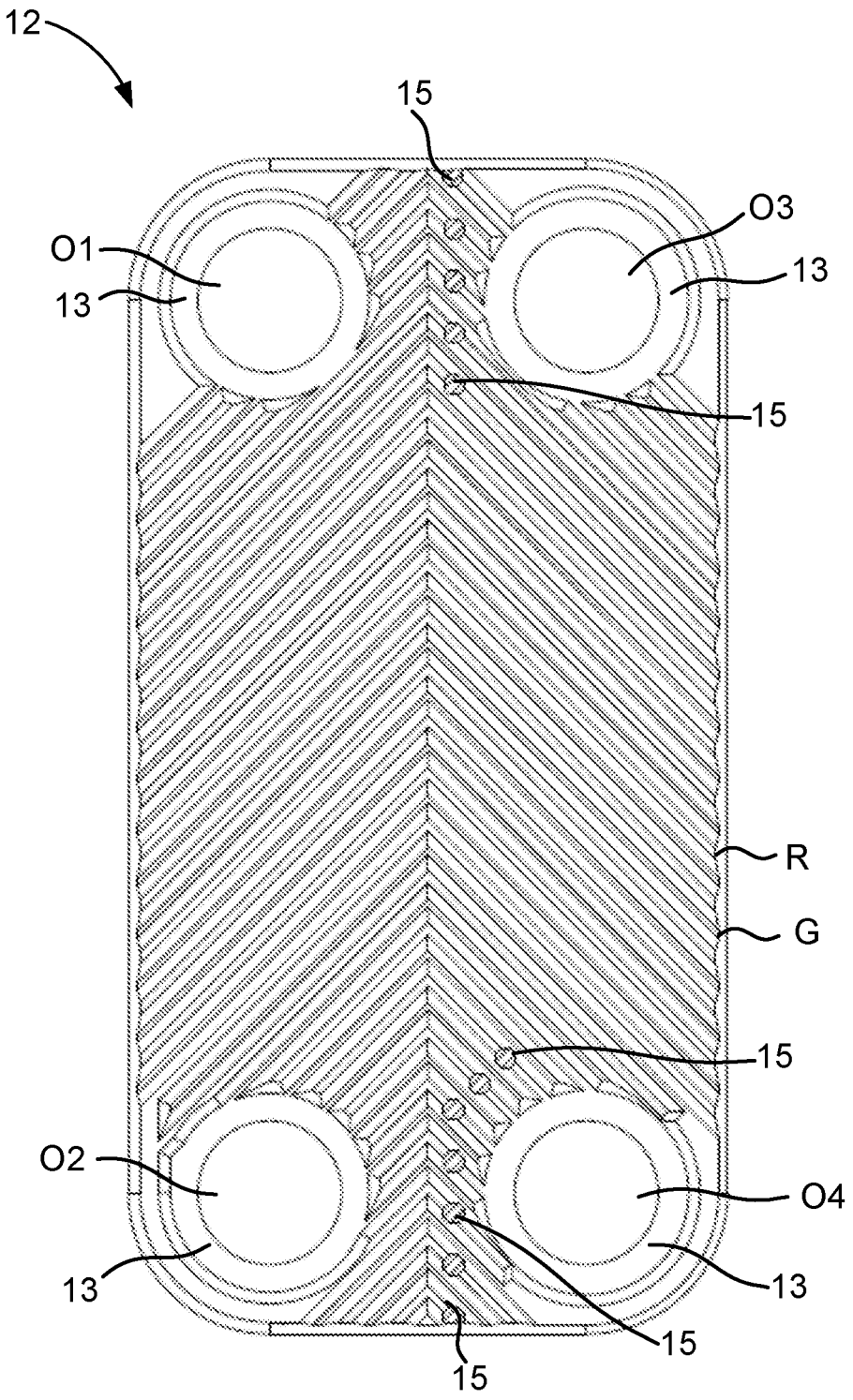
FIG. 5 is a schematic front view of a heat exchanger plate according to FIG. 4.
Figure 6:
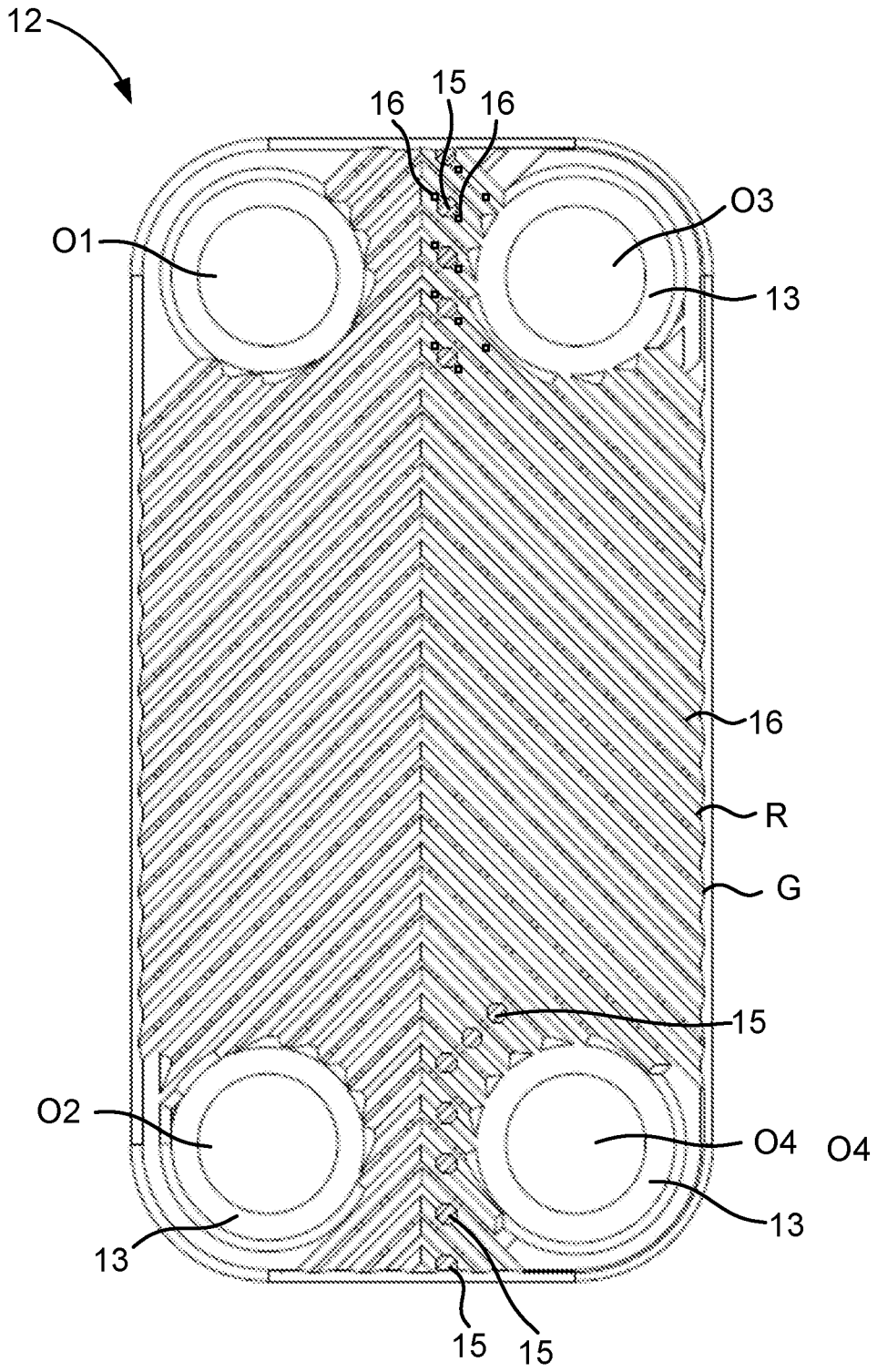
FIG. 6 is a schematic front view of the heat exchanger plate of FIG. 5 illustrating imaginary contact points between the illustrated plate and a further heat exchanger plate.

With reference to FIGS. 4-6 a second embodiment of a heat exchanger 10 is illustrated, wherein the end plate 11 is similar to the one described above with reference to FIG. 1. Also, in FIG. 4 some port openings are left out, which is understood by a skilled person. In the embodiment of FIGS. 4-6 the heat exchanger plates 12 are identical and provided with a herringbone pattern of ridges R and grooves G, wherein every other heat exchanger plate 12 is rotated 180 degrees in its plane.

With reference also to FIG. 5, the heat exchanger plate 12 is provided with a plurality of the indentations 15 forming a trans-ridge channels and connecting neighbouring grooves G. In the illustrated embodiment, the indentations 15 are arranged in ridges R of the heat exchanger plate 12 in the vicinity of and at a distance to the port openings O3, O4 to connect neighbouring grooves G and prevent stagnant media in the flow channels formed between the flat areas 14 and the adjacent heat exchanger plate 12. In the embodiment of FIGS. 4-6 all ridges R in the area between the first port opening 1 and the third port opening O3 are provided with an indentation 15 leaving space for a contact point 16, and thus a brazing joint, between the port opening area 13 of the third and fourth port openings O3, O4 and each indentation 15 as illustrated schematically in FIG. 6. Also in FIG. 6 the contact points 16 are illustrated schematically between the heat exchanger plate 12 and a further heat exchanger plate behind the illustrated one, wherein the contact points 16 on the front side towards another heat exchanger plate 12 is understood by a skilled person to be in the corresponding positions on the ridges R as illustrated schematically for a few positions by means of squares in the vicinity of the third port opening O3 in FIG. 6. As can be seen in FIG. 6 the indentations 15 are arranged with a distance to the port opening area 13 of the third port opening O3 and the fourth port opening O4 leaving space for a brazing joint between the indentation 15 and the port opening O3, O4. Hence, a brazing joint is arranged between the port opening area 13 and the indentations 15.

In the embodiment of FIGS. 4-6 all but one of the indentations 15 in each end of the plate are provided between contact points 16. Hence, most of the indentations 15 are arranged between contact points 16. For example, at least four or at least five indentations 15 are arranged in the vicinity of the third port opening O3, whereas more, such as at least six or seven, indentations 15 are arranged in the vicinity of the fourth port opening O4. In the embodiment of FIGS. 4-6 the indentations 15 in the vicinity of the third port opening O3 are arranged in a straight line in a longitudinal direction of the heat exchanger plate 12, such as in parallel to a longitudinal centre line of the plate. For example, the indentations 15 form a continuous trans-ridge flow channel between the first and last of the indentations 15 in a row of indentations 15. For example, the indentations 15 in the vicinity of the fourth port opening O4 are arranged in a corresponding manner, optionally with additional indentations 15 deviating from said straight line. For example, the heat exchanger plates 12 are connected to each other by a plurality of rows of contact points 16, wherein a plurality of indentations 15 is arranged between the first and second rows of contact points 16 counted from the nearest port opening area 13. Hence, indentations 15 are arranged outside the first row of contact points 16. For example, a row of indentations 15 forming a continuous trans-ridge flow channel is arranged outside a first row of contact points 16.

Figure 7:
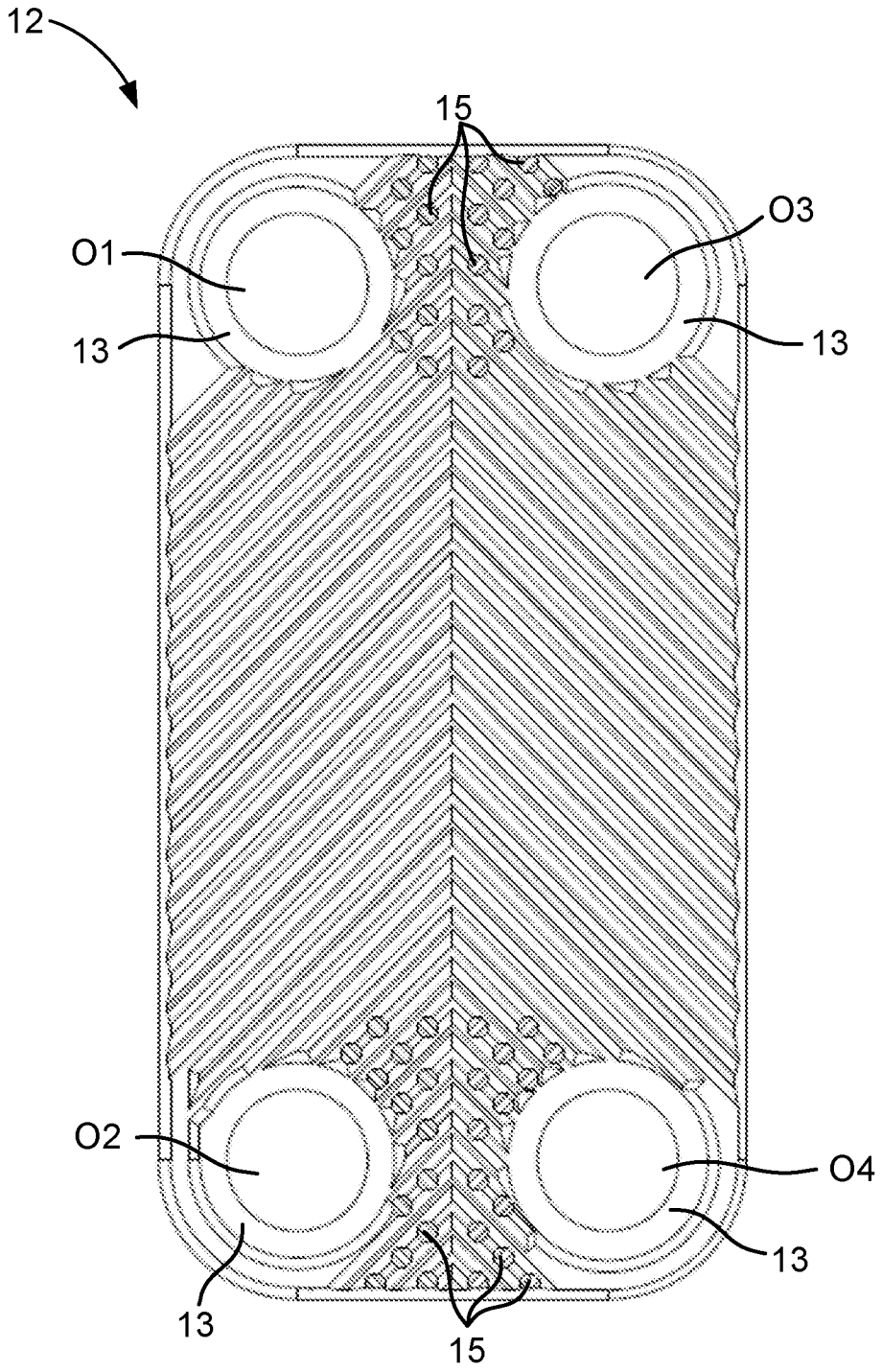
FIG. 7 is a schematic front view of a heat exchanger plate according to a third embodiment.
Figure 8:
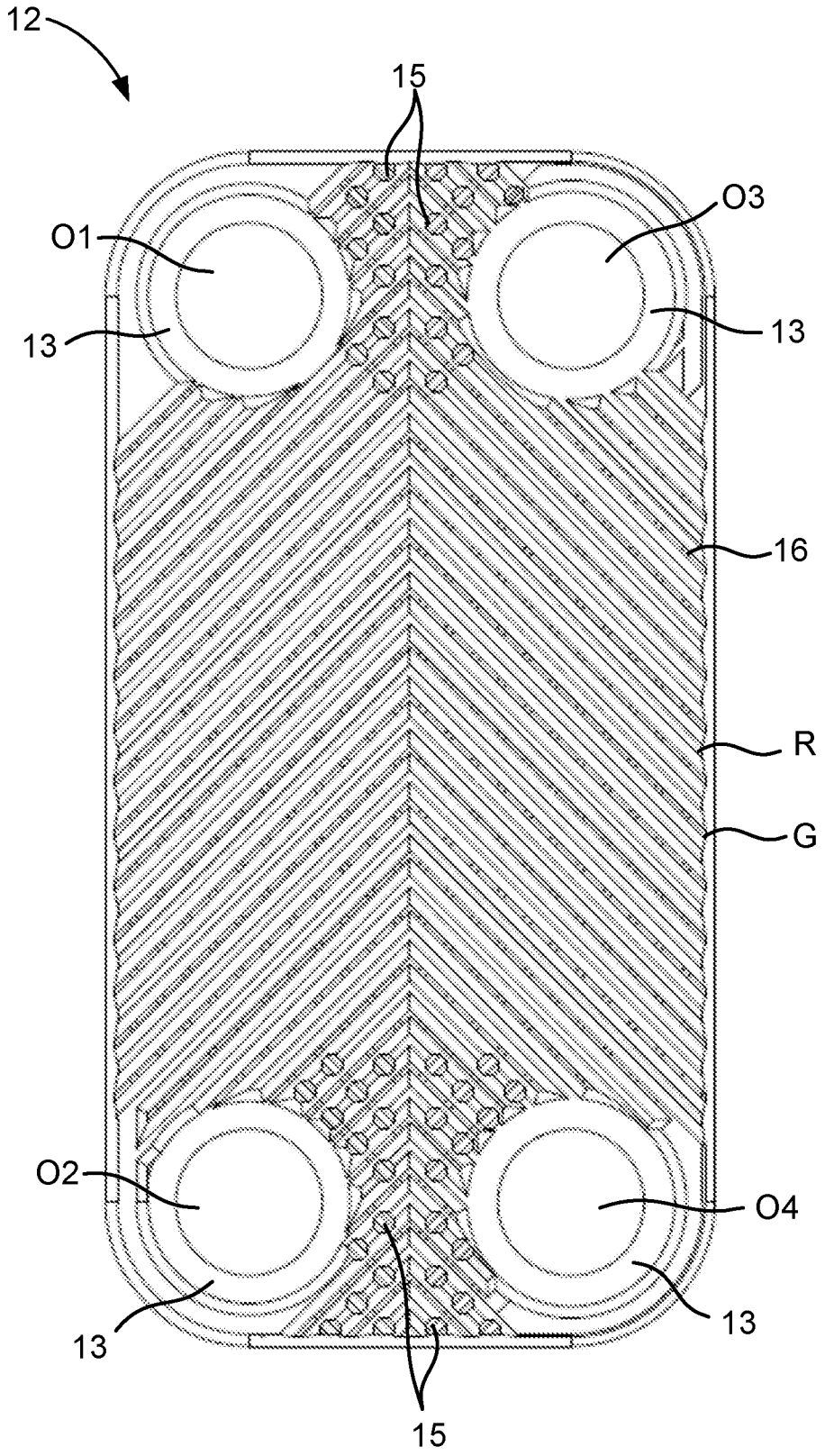
FIG. 8 is a schematic front view of the heat exchanger plate of FIG. 7 illustrating imaginary contact points between the illustrated plate and a further heat exchanger plate.

With reference to FIGS. 7 and 8, the heat exchanger plate 12 is provided with a plurality of the indentations 15 forming trans-ridge channels in another pattern, wherein a plurality of indentations 15 are distributed between the first port opening O1 and the third port opening O3 between the contact points 16. In the embodiment of FIGS. 7 and 8 a larger number of indentations 15 are distributed in a similar pattern over a bigger area between the second port opening O2 and the fourth port opening O4. For example, the pattern of indentations 15 is a regular pattern.

Figure 9:
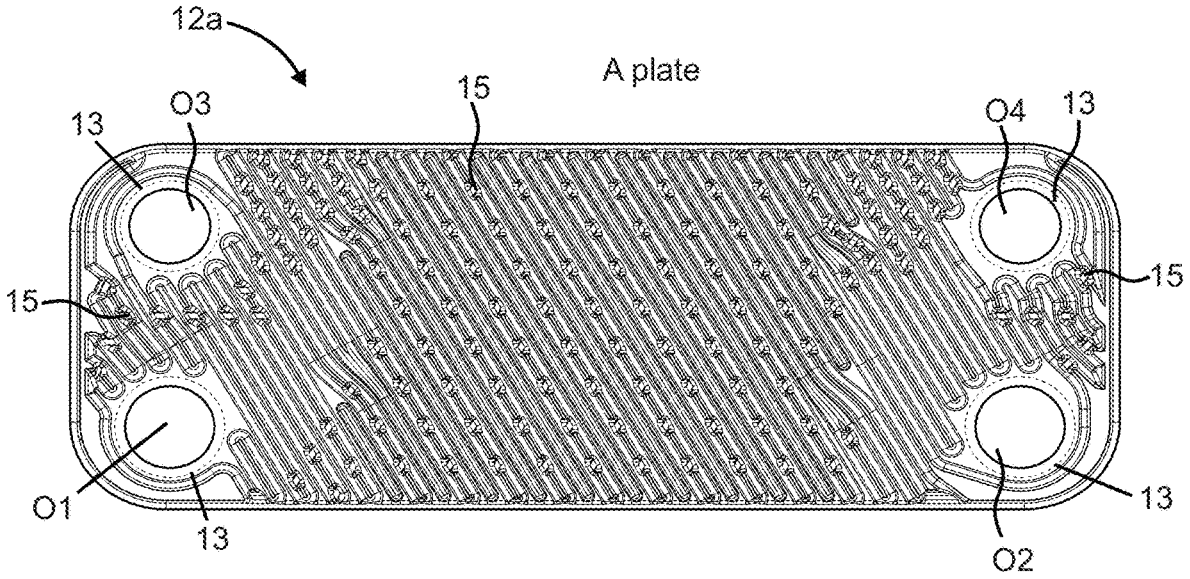
Figure 10:
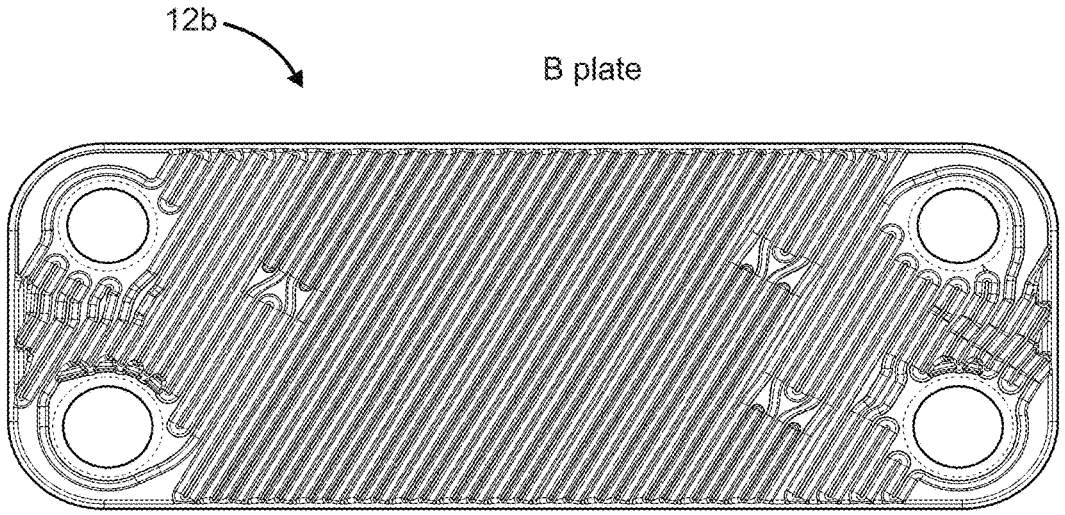

With reference to FIGS. 9 and 10 another embodiment of the invention is illustrated, wherein FIG. 9 illustrates a first type of heat exchanger plate 12*a* and FIG. 10 illustrates a second type of heat exchanger plate 12*b*. The first and second types of heat exchanger plates 12*a*, 12*b* are stacked alternatingly and are provided with the end plate 11 to form a heat exchanger 10. The first and second types of heat exchanger plates 12*a*, 12*b* are provided with a pattern with ridges R and grooves G in the form of obliquely extending straight lines. Hence, the heat exchanger 10 in the embodiment of FIGS. 9 and 10 comprises two different types of heat exchanger plates 12*a*, 12*b* having a pattern of ridges R and grooves G forming interplate flow channels, wherein flow channels are formed between the flat areas 14 of the end plate 11 and the adjacent heat exchanger plate 12*a* in the areas between the port openings O1-O4, wherein the adjacent heat exchanger plate 12*a* being of the first type. At least the first type of heat exchanger plates 12*a* is provided with indentations 15 forming trans-ridge flow channels to prevent dead-end flow channels between the flat areas 14 of the end plate and the neighbouring heat exchanger plate 12*a*. In the embodiment of FIGS. 9 and 10 indentations 15 are also distributed over a large portion of the first type of heat exchanger plates 12*a*, including a central heat exchanging area.

Figure 11:
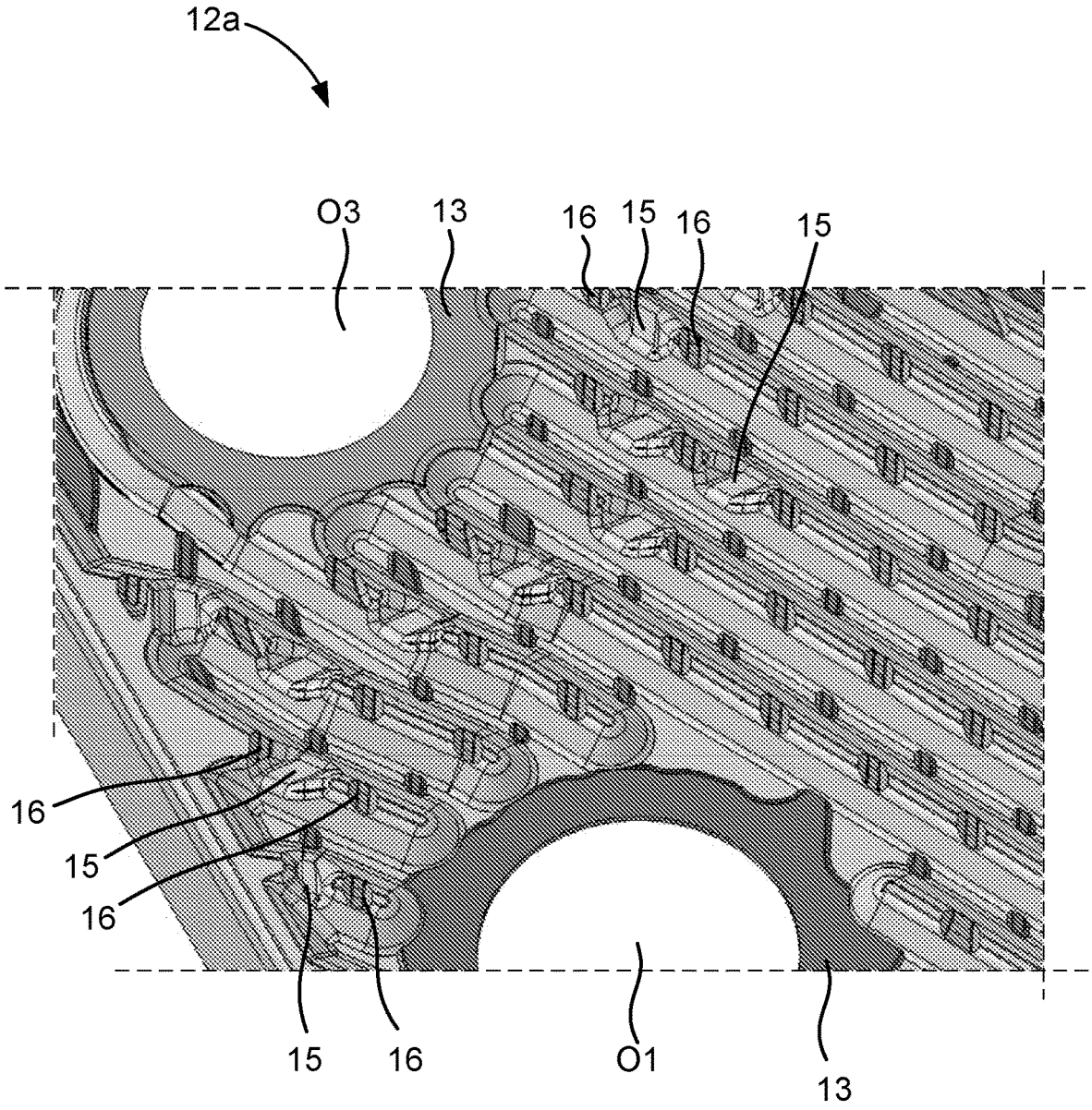
FIG. 11 is a schematic perspective view of a part of a heat exchanger plate according to FIG. 9, illustrating imaginary contact points between the illustrated plate and a further heat exchanger plates in both directions.

With reference to FIG. 11 the contact points 16, and thus brazing joints, are illustrated schematically on a part of the first type heat exchanger plate 12*a*. The contact points 16 are illustrated for both sides of the plate 12*a*. Hence, as can be seen in FIG. 11, the indentations 15 in the vicinity of the port openings O1-O4, or at least most of them, are arranged between contact points 16. Hence, a contact point 16 is provided between the port opening area 13 and the nearest indentation 15 forming a trans-ridge channel connecting neighbouring grooves G in the area overlapping the flat area 14, wherein another contact point 16 is arranged on the ridge R on the other side of the same indentation 15. For example, contact points 16 between adjacent heat exchanger plates 12 are arranged immediately before and after an indentation 15 in the area overlapping the flat area 14 of the end plate 11. connecting a flow channel with a neighbouring flow channel. Hence, indentations 15 of a heat exchanger plate 12*a* adjacent the end plate 11 connect a flow channel, formed between the flat areas 14 of the end plate 11 and the adjacent heat exchanger plate 12*a*, with a neighbouring flow channel to allow distribution of media between them and prevent stagnant media therein while brazing joints are arranged between neighbouring heat exchanger plates 12*a*, 12*b* in positions between the port opening area 13 and the indentations 15 to provide a strong heat exchanger 10.

The invention claimed is:

1. A brazed plate heat exchanger comprising an end plate and a stack of heat exchanger plates provided with a pattern comprising ridges and grooves adapted to form contact points between neighboring heat exchanger plates such that the heat exchanger plates form interplate flow channels for media to exchange heat over the heat exchanger plates, the heat exchanger plates further being provided with port openings for selective fluid communication with the flow channels, wherein the port openings are surrounded by port opening areas for sealing against a corresponding port opening area of a neighboring heat exchanger plate, wherein neighboring heat exchanger plates are connected by brazing joints at said contact points, wherein the end plate is provided with port openings and flat areas around the port openings in a common plane, wherein a plurality of the ridges of the heat exchanger plates, in an area overlapping any of said flat areas of the end plate, are formed with indentations, wherein said indentations of a heat exchanger plate adjacent the end plate connect a flow channel, formed between the end plate and the adjacent heat exchanger plate, with a neighboring flow channel, formed between the end plate and the adjacent heat exchanger plate, to allow distribution of said media between them, and wherein at least one of the indentations is arranged a distance from the flat area around a closest of the port openings, and one of said brazing joints for connecting said neighboring heat exchanger plates is arranged between said flat area around a closest of the port openings and said at least one of the indentations.

2. The brazed heat exchanger according to claim 1, wherein some of said contact points are arranged on the ridge on both sides of at least one of said indentations connecting one of said flow channels, formed between the end plate and the adjacent heat exchanger plate, with one of said neighboring flow chanels, formed between the end plate and the adjacent heat exchanger plate, to allow distribution of said media between them.

3. The brazed heat exchanger according to claim 1, wherein the heat exchanger plates are connected to each other by a plurality of rows of said brazing joints, and wherein a plurality of said indentations is arranged between the first and second rows of brazing joints counted from the closest port opening area.

4. The brazed heat exchanger according to claim 1, wherein some of said brazing joints for connecting neighboring heat exchanger plates are arranged immediately adjacent said indentations.

5. The brazed heat exchanger according to claim 1, wherein some of said brazing joints for connecting neighboring heat exchanger plates are arranged immediately adjacent said indentations.

6. The brazed heat exchanger according to claim 1, wherein the heat exchanger plates are formed with said indentations in positions for connecting at least every other of said flow channels, formed between the end plate and the adjacent heat exchanger plate, with one of said neighboring flow channels, formed between the end plate and the adjacent heat exchanger plate, to allow distribution of said media between them.

7. The brazed heat exchanger according to claim 1, wherein the pattern comprising said ridges and grooves are formed with a corrugation depth, and wherein the indentations are formed with a depth corresponding to at least 5% of the corrugation depth.

8. The brazed heat exchanger according to any claim 7, wherein the depth of the indentations is 30-80% of the corrugation depth.

9. The brazed heat exchanger according to claim 1, wherein the end plate, in a central portion thereof, is formed with a pattern of ridges and grooves.

10. The brazed heat exchanger according to claim 1, wherein the port opening areas of the heat exchanger plates are arranged on different levels.

11. The brazed heat exchanger according to any claim 7, wherein the depth of the indentations is 40-60% of the corrugation depth.

12. The brazed heat exchanger according to any claim 7, wherein the depth of the indentations is 50% of the corrugation depth.

* * * * *